US005881735A

United States Patent [19]

Kutnik

[11] Patent Number: 5,881,735

[45] Date of Patent: Mar. 16, 1999

[54] NAIL CLIPPER

[76] Inventor: Alexander Kutnik, 1786 Springfield Road, Winnipeg, Manitoba, Canada, R2C 2Z2

[21] Appl. No.: 69,297

[22] Filed: Apr. 29, 1998

[51] Int. Cl.[6] ..... A45D 29/18

[52] U.S. Cl. ..... 132/75.4; 132/73; 30/29

[58] Field of Search ..... 132/75.4, 73, 73.5, 132/75.3; 30/29, 26, 27, 28, 124, 125, 131

[56] References Cited

U.S. PATENT DOCUMENTS

| | | |
|---|---|---|
| 1,434,441 | 11/1922 | Kohn et al. . |
| 1,828,121 | 10/1931 | Dam et al. . |
| 2,753,626 | 7/1956 | Bowers . |
| 2,887,773 | 5/1959 | Killen . |
| 3,180,025 | 4/1965 | Tsunemi . |
| 3,299,505 | 1/1967 | Pionek . |
| 3,943,948 | 3/1976 | Sartore . |
| 4,602,430 | 7/1986 | Allen, Jr. . |
| 4,776,090 | 10/1988 | Grassi . |

*Primary Examiner*—Gene Mancene
*Assistant Examiner*—Pedro Philogene
*Attorney, Agent, or Firm*—Adrian D. Battison; Murray E. Thrift

[57] ABSTRACT

The present invention provides a nail clipper having a container for collecting and containing cut finger and toe nails. The container has separable first and second portions to allow for easy disposal of cut material. The first portion has an open bottom wall and the second portion has an open top wall and is removable from the first portion. The open top of the second portion is removably and reengageably attached to the open bottom of the first portion, such that the second portion slidably engages within the first portion of the container. The container includes a utensil or utensils, for example a nail file, in a receptacle in the second portion. The utensil can be used both when the second portion is attached to the first portion and when the second portion is detached from the first portion. The clippers are provided by a lower cutting edge fixed along a top edge of a front wall of the first portion of the container, and an upper cutting edge arranged above the lower cutting edge on an elongate resilient member. An actuator is arranged to move the elongate resilient member so that the upper and lower cutting edges are moved between an open position spaced from one another and a closed position in contact with one another thereby cutting a nail and causing said nail to fall into the container.

19 Claims, 6 Drawing Sheets

NAIL CLIPPER

FIELD OF THE INVENTION

The present invention provides an improved nail clipper of the type for cutting finger and toe nails, particularly of the type having a integral container for collecting and containing cut nails.

BACKGROUND

When cutting finger and toe nails a nail clipper is commonly used Most nail clippers in use are of a similar design comprising a pair of elongate members fixed together at one end with co-operating spaced apart cutting edges arranged at the other end, and with open sides. The finger or toe nail is cut by placing it between the cutting edges and actuating a lever member which moves the cutting ends of the two resilient members towards one another.

Nail clippers of this type do not capture or contain the nails after they have been cut. The cut nails instead tend to fly away from the cutting edges, sometimes considerable distances, which requires that they be gathered up before they can be disposed of. This presents a problem in that it is inconvenient to have to gather up the cut nails and can sometimes be difficult since the cut nails often fly off in different directions and can be difficult to find.

This problem has been addressed in the past by devices which are attached to a nail cutter of the type described. Most of these devices capture the nails after cutting but lack a means for containing the nails when the nail clipper is not in use thereby requiring that the devices be emptied after every use.

Nail clippers are often used with a nail file and scissors. These are usually separate from the nail clipper and have a tendency to be misplaced or used without the nail clipper for different tasks. This often requires that the nail clippers, scissors, and nail file be found before they can be used to cut and shape the nails. Looking for these items can be time consuming and frustrating.

An improved nail clipper is needed which includes a container that is integral to the nail clippers, and captures and contains cut finger and toe nails, and which includes a means for providing a nail clipper, a nail file, and other utensils in a single device.

SUMMARY

According to one aspect of the present invention there is provided a nail clipper for cutting finger and toe nails comprising:

a container for collecting and containing cut nails including:

a first portion having a front wall, side walls, a rear wall, and an open bottom wall;

a second portion having a front wall, side walls, a rear wall, an open top wall, and a closed bottom wall, said second portion being arranged to slidably engage within at least a portion of the first portion of the container;

and removable and reengageable attachment means for attaching the open top of the second portion within the open bottom of the first portion;

a lower cutting edge arranged adjacent a top edge of the front wall of the first portion of the container;

an elongate resilient member arranged above the lower cutting edge and extending between the side walls of the first portion for movement therebetween, such that the elongate resilient member encloses a top of the first portion;

an upper cutting edge arranged along a front end of the elongate resilient member for co-operation with the lower cutting edge;

and actuator means for selectively moving the front end of the elongate resilient member downwards such that the upper cutting edge contacts the lower cutting edge;

and wherein the second portion includes at least one receptacle having a utensil arranged therein, said utensil being pivotally connected at one end within the receptacle such that the utensil can be pivoted free of the receptacle for use and such that the utensil can be folded back into the receptacle for storage.

According to a second aspect of the present invention there is provided a nail clipper for cutting finger and toe nails comprising:

a container for collecting and containing cut nails including:

a first portion having a front wall, side walls, a rear wall, and an open bottom wall;

a second portion having a front wall, side walls, a rear wall, an open top wall, and a closed bottom wall, said second portion being arranged to slidably engage within at least a portion of the first portion of the container;

and removable and reengageable attachment means for attaching the open top of the second portion within the open bottom of the first portion;

a lower cutting edge arranged adjacent a top edge of the front wall of the first portion of the container;

an elongate resilient member arranged above the lower cutting edge and extending between the side walls of the first portion for movement therebetween, such that the elongate resilient member encloses a top of the first portion;

an upper cutting edge arranged along a front end of the elongate resilient member for co-operation with the lower cutting edge;

and actuator means for selectively moving the front end of the elongate resilient member downwards such that the upper cutting edge contacts the lower cutting edge.

According to another aspect of the present invention there is provided a nail clipper for cutting finger and toe nails comprising:

a container for collecting and containing cut nails having a front wall, side walls, a rear wall, and an open bottom wall;

a lower cutting edge arranged adjacent a top edge of the front wall;

an elongate resilient member arranged above the lower cutting edge and extending between the side walls for movement therebetween, such that the elongate resilient member encloses a top of the container;

an upper cutting edge arranged along a front end of the elongate resilient member for co-operation with the lower cutting edge;

actuator means for selectively moving the front end of the elongate resilient member downwards such that the upper cutting edge contacts the lower cutting edge;

and a recessed portion arranged in at least one of the side walls of the container in an exterior surface thereof, said recessed portion being sized and arranged to receive a label therein.

BRIEF DESCRIPTION OF THE DRAWINGS

In the accompanying drawings, which illustrate an exemplary embodiment of the present invention.

In the drawings like characters of reference indicate corresponding parts in the different figures.

DETAILED DESCRIPTION

Figure 1:
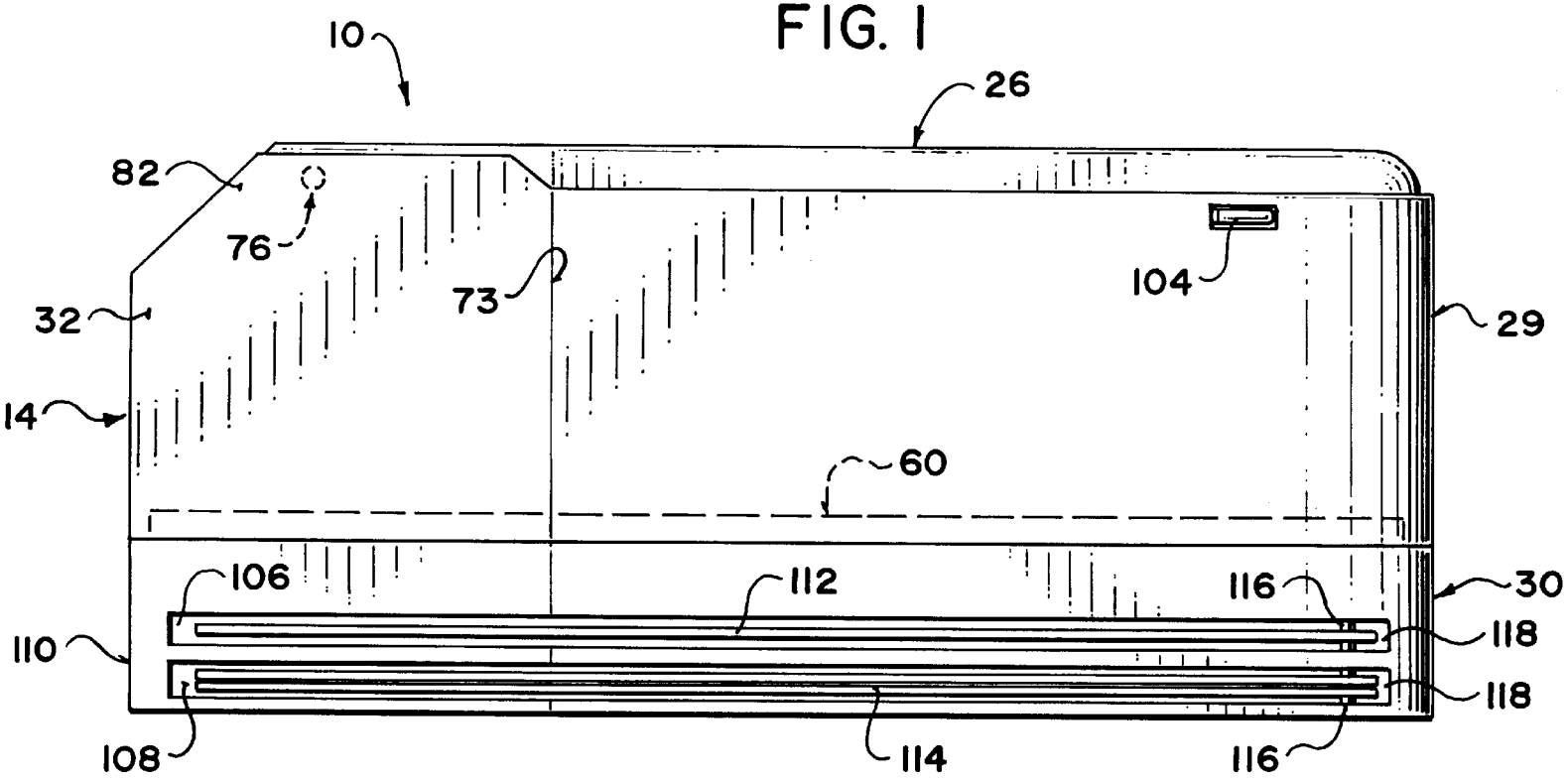
FIG. 1 is a side view of the nail clipper.
Figure 9:
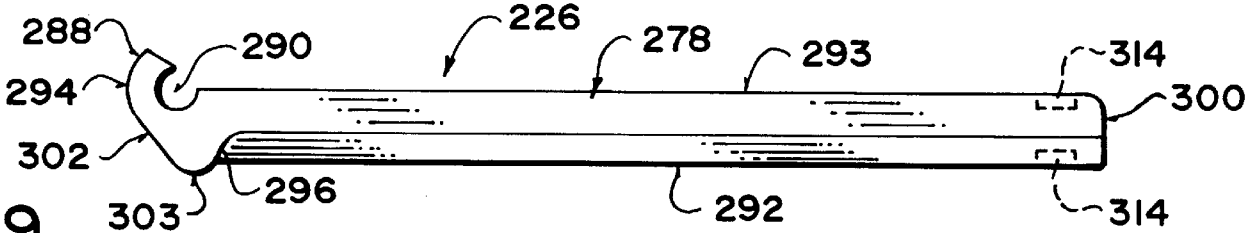
FIG. 9 is a side view of the actuating lever in the alternative embodiment of the nail clipper.
Figure 2:
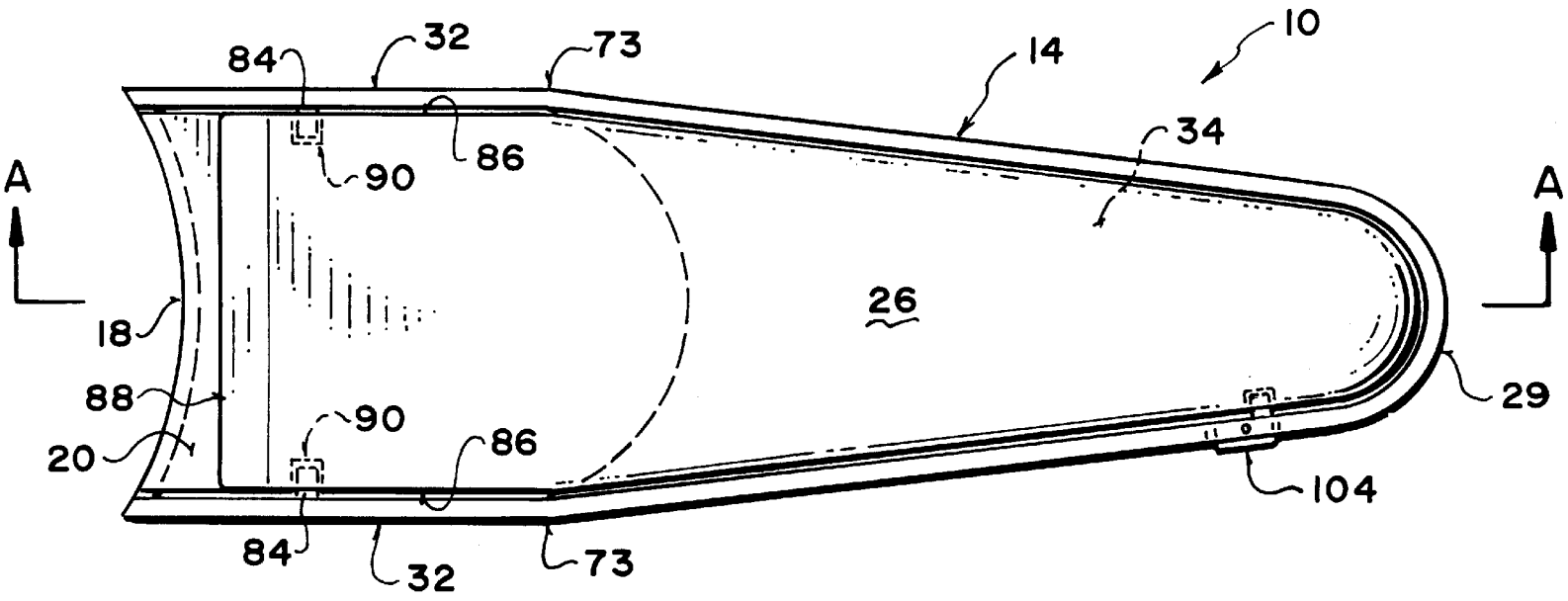
FIG. 2 is a top view of the nail clipper with the actuator lever removed.
Figure 4:
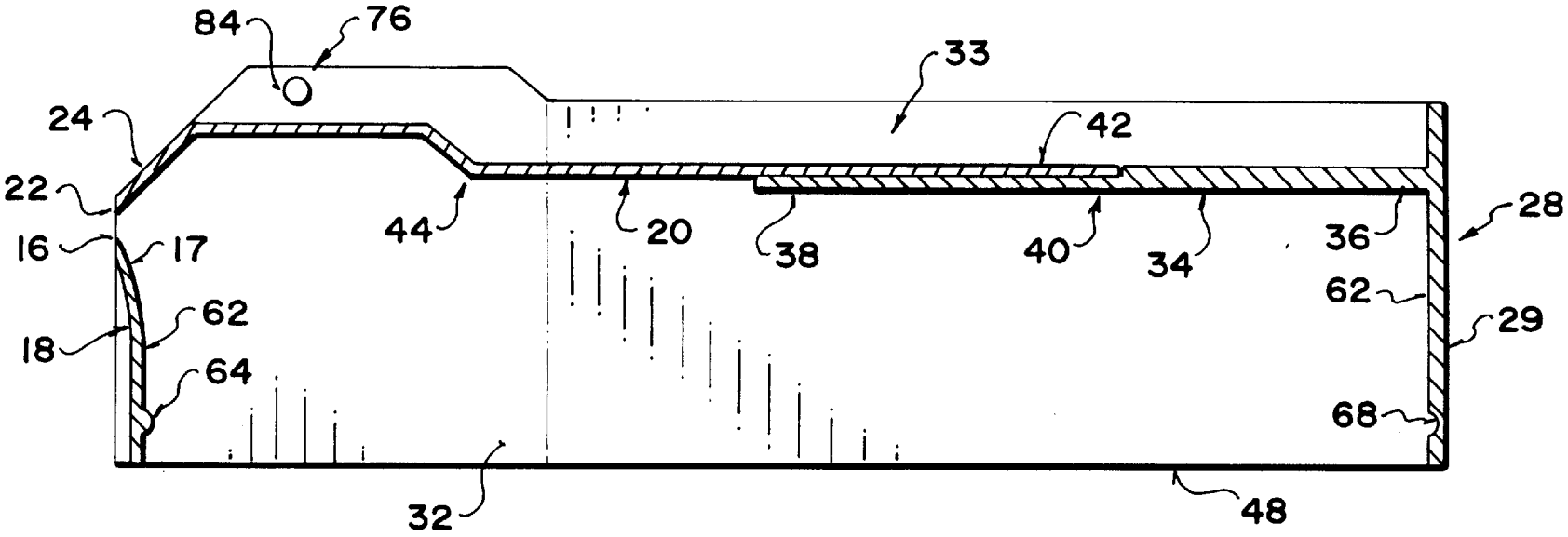
FIG. 4 is a cross sectional view of the first portion of the nail clipper through A—A of FIG. 2.

Referring to FIGS. 1, 2 and 4 the nail clipper is shown generally at 10. The nail clipper 10 comprises a container 14 for collecting and containing cut nails, a lower cutting edge 16 fixed along a top edge 17 of a front wall 18 of the container 10, an elongate resilient member 20 arranged above the lower cutting edge 16, an upper cutting edge 22 arranged along a front end 24 of the elongate resilient member 20 for co-operation with the lower cutting edge 16, and actuator means 26 for selectively moving the front end 24 of the elongate resilient member 20 downwards such that the upper cutting edge 22 contacts the lower cutting edge 16.

Referring to FIGS. 1,2, 4 and 5 the container 14 includes a first portion 28 and a removable and reengageable second portion 30.

The first portion 28 has a front wall 18, a rear wall 29 opposite the front wall 18, spaced apart side walls 32 extending between the front and rear walls 18 and 29, and a closed top 33. A support flange 34 for supporting the elongate resilient member 20 thereon is fixed to the rear wall 29 at a rear end 36 and extends forwards of the rear wall 29 to a front end 38. The support flange 34 extends laterally to the side walls 32 of the container 14 and is fixed to the side walls 32 thereby enclosing a first portion 40 of the top 33 of the container 14.

The front wall 18 of the container 14 extends laterally between the side walls 32 in a U shaped curve, and curves upwards and outwards to the top edge 17. The upwards and outwards curve angles the top edge 17 of the front wall 18 such that it provides the lower cutting edge 16. The lower cutting edge 16 is therefor integral to the container 14 and does not move relative to the container 14 when cutting. The lower cutting edge 16 may also be provided by other means, for example, by tapering the top edge 17 of the front wall 18 to provide a sharp edge or by fixing a blade to the top edge 14 of the front wall 18.

The elongate resilient member 20 is fixed at its rear end 42 to the front end 38 of the support member 34, in a cantilever, and extends forwards therefrom to the front wall 18. The elongate resilient member 20 lies between the side walls 32 of the container 14 enclosing a second portion 44 of the top 33 of the container 14. The front end 24 of the elongate resilient member 20 is positioned above a top edge 17 of the front wall 18 spaced upwards therefrom. The front end 24 of the elongate resilient member 20 is free to move between the side walls 32, parallel to the side walls 32.

The upper cutting edge 22 is arranged along the front end 24 of the elongate resilient member 20 and is arranged for co-operation with the lower cutting edge 16 arranged below. The upper cutting edge 22, like the lower cutting edge 16, extends laterally between the side walls 32 in a U-shaped curve, and is formed by an angled cut along the front end 24 of the elongate resilient member 20.

Figure 5:
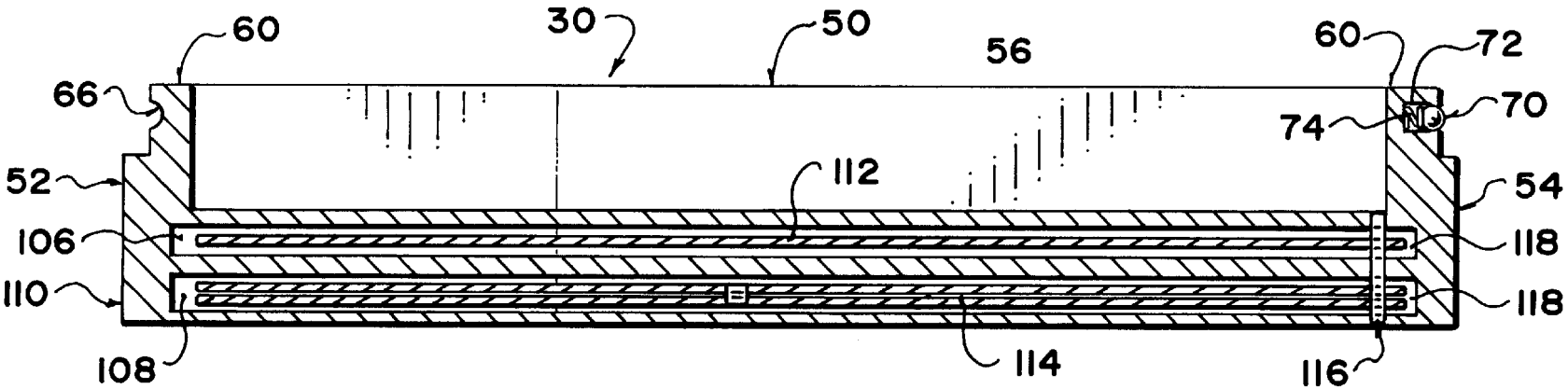
FIG. 5 is a cross sectional view of the second portion of the nail clipper through A—A of FIG. 2.

Referring to FIGS. 1, 4 and 5 the second portion 30 of the container 14 is attached to a bottom 48 of the first portion 28 and is removable and reengageable therefrom. The second portion 30 includes an open top wall 50, a front wall 52, a rear wall 54, side walls 56, a closed bottom wall 54, and removable and reengageable attachment means for attaching the open top 50 of the second portion 30 to the open bottom 48 of the first portion 28. This arrangement provides a closed container yet allows for easy disposal of any cut nails contained within by removing the second portion 30.

The second portion 30 is arranged such that a top portion 60 of the second portion 30 fits within the open bottom 48 of the first portion 28 of the container 14. This is achieved by spacing the top portion 60 of the front, rear, and side walls 52, 54, and 56 of the second portion 30 inwards from respective outer surfaces thereof.

The attachment means are arranged on the top portion 60 of the second portion of the container 14 and on the interior walls of the first portion 28 of the container 14. The attachment means preferably comprise snap fasteners. Any appropriate type of removable and reengageable fastener means may be substituted, however, the following example of a snap fastener is preferable. The snap fasteners comprise a raised member 64 located on the interior of the front wall 18 of the first portion 28 of the container 14 and a corresponding recess 66 for receiving the raised member 64 located in the top portion 60 of the front wall 52 of the second portion 30. A second recess 68 is located in the interior of the rear wall 29 of the first portion 28 and a ball member 70 for engaging the second recess 68 is located in the top portion 60 of the rear wall 54 of the second portion 30 of the container 14. The ball member 70 is located in a recess 72 and is biased outwards by a spring 74 within the recess 72. When the second portion 30 is positioned within the first portion 28 the raised member 64 engages the recess 66 and the ball member 70 engages the recess 68 thereby holding the second portion 30 in place within the first portion 28. Application of a downwards force on the second member 30 causes the ball member 70 to be forced out of the recess 68 and into the recess 72 allowing the second portion 30 to be removed from the first portion 28.

Referring to FIG. 2 the side walls 32 of the first and second portions 28 and 30 of the container 14 when viewed from above extend rearwards of the front wall 18 parallel to one another to a first point 73 then angle slightly inwards towards one another to the rear wall 30. The rear wall 30 is curved in a portion of a circle extending between the side walls 32. This shape provides a handle for the grasping by the individual when using the nail clippers.

Figure 3:
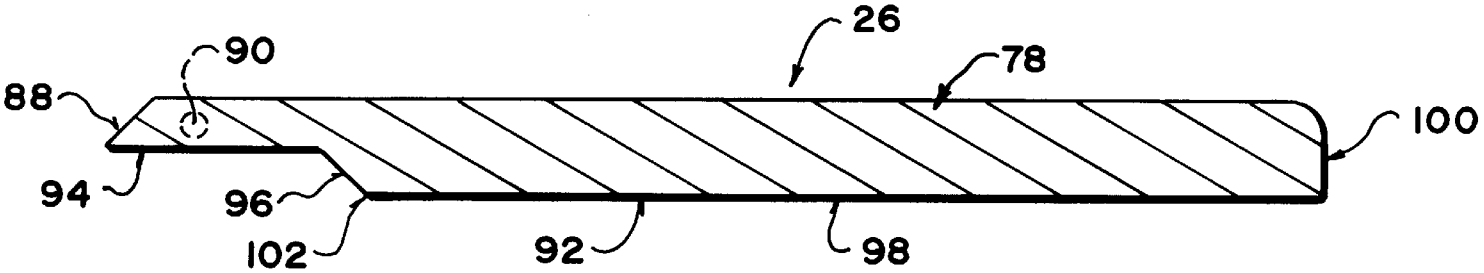
FIG. 3 is a cross sectional view of the actuating lever through A—A of FIG. 2.
Figure 6:
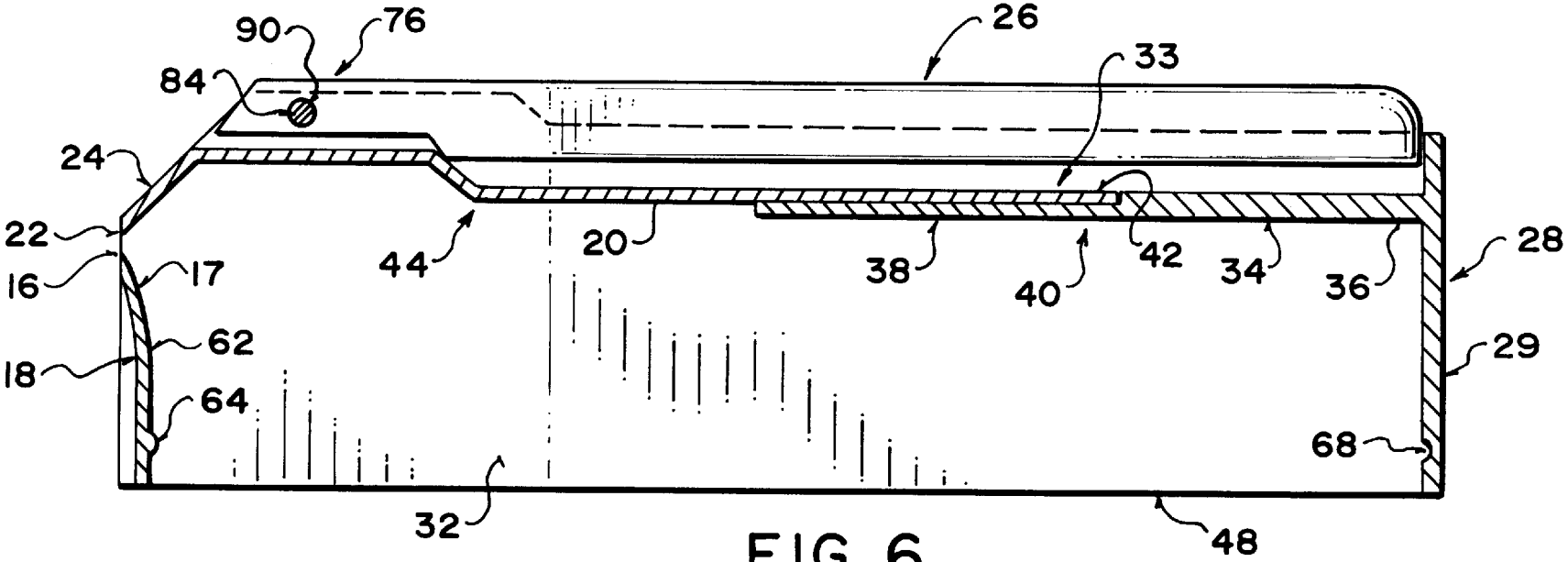
FIG. 6 is a side cross sectional view of the nail clipper with the side wall removed.
Figure 10:
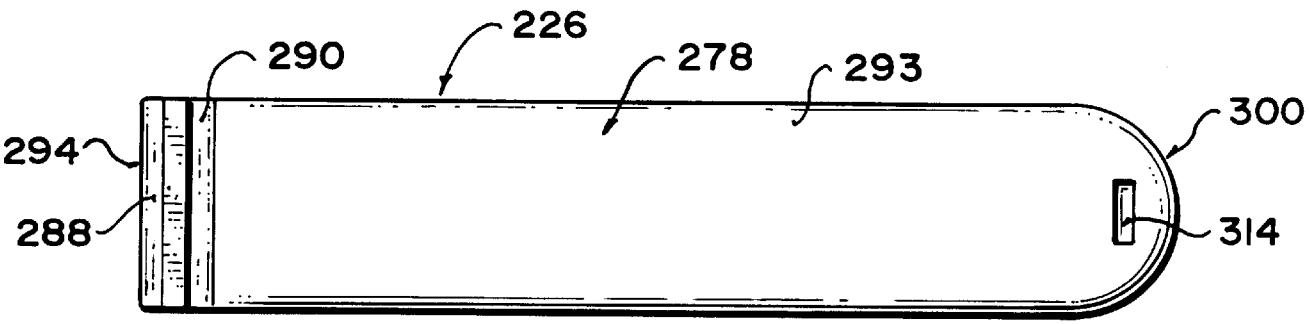
FIG. 10 is a top view of the actuating lever in the alternative embodiment of the nail clipper.

Referring to FIGS. 3, 4, and 6 the actuator means 26 comprise a pivot connection 76, an elongate lever member 78 and a contact point 102. The actuator means 26 selectively move the upper and lower cutting edges 16 and 22 from an open position to a closed position by moving the front end 24 of the elongate resilient member 20 downwards. When in the open position the upper cutting edge 22 is spaced from the lower cutting edge 16, and when in the closed position the upper cutting edge contacts the lower cutting edge 16 thereby cutting a nail placed between the cutting edges and causing the nail to fall into the container.

The actuator means 26 comprises a lever member arranged above and spaced from the elongate resilient member 20 and is connected to the side walls 32 of the container 14 adjacent a front end 82 thereof. The lever member 26 is connected to the side walls 32 of the container 14 by the pivot connector 76. The front end 82 of each side wall 32 of the container 14 extends upwards above the elongate resilient member 20 and has a pin member 84 extending inwards towards the sides 86 of the lever member 26 adjacent a front end 88 thereof. Each pin member 84 engages a respective receptacle 90 in the sides 84 of the actuator lever 26.

The actuator lever 26 comprises the elongate member 78 extending rearwards from the pivot connection 84. The elongate member has a bottom surface 92 having a first portion 94 extending rearwards from the front end 88 to a second portion 96. The second portion 96 extends downwards and rearwards at an angle to a third portion 98. The third portion 98 extends rearwards to a rear end 100 of the elongate lever. A contact point 102 is provided by the corner of the second portion 96 and third portion 98.

Downwards movement of the lever member 26 causes downwards movement of the contact point 102, which engages the elongate resilient member 20 adjacent its front end 24. This causes downwards movement of the front end 24 of the elongate resilient member 20 such that the upper cutting edge 22 moves from the open position to the closed position and into contact with the stationary lower cutting edge 16 in a cutting motion.

Referring to FIG. 1 the nail clipper 10 includes a locking means 104 for selectively locking the lever mechanism 26 in the closed position when not in use. This fully encloses the container 14 thereby preventing cut nails from exiting the container 14.

Referring to FIG. 1 and 5 the nail clipper 10 includes two receptacles 106 and 108 in a bottom portion 110 of second portion 30 of the container 14, one having a nail file 112 arranged therein, and the other having scissors 114 arranged therein. The nail file 112 and scissors 114 are each pivotally connected at a respective end 116 adjacent an end 118 of the respective receptacle 106 and 108 such that they can be pivoted free of the receptacle 106 and 108 for use and can be folded back into the receptacle 106 and 108 for storage. Each receptacle encloses the nail file, scissors, or utensil located within receptacle on the top, bottom, and on three sides. Additional receptacles may be provided for other utensils if desired, or one, or both of the receptacles may be excluded.

An alternative arrangement of the nail clipper is shown generally as 210 in FIGS. 7 to 11. Except where indicated in the following the nail clipper 210 is otherwise the same as that described above.

Figure 7:
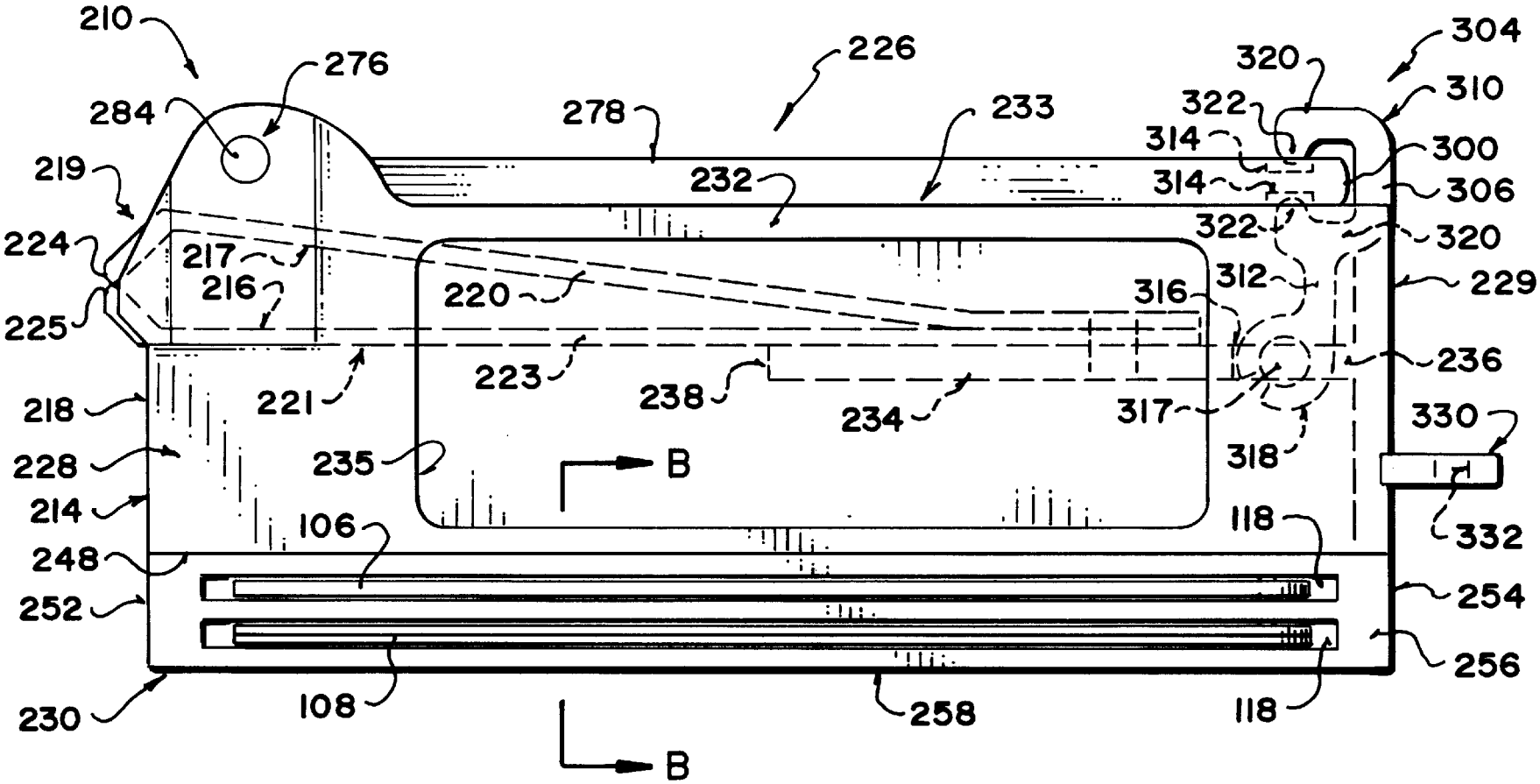
FIG. 7 is a side view of an alternative embodiment of the nail clipper.
Figure 8:
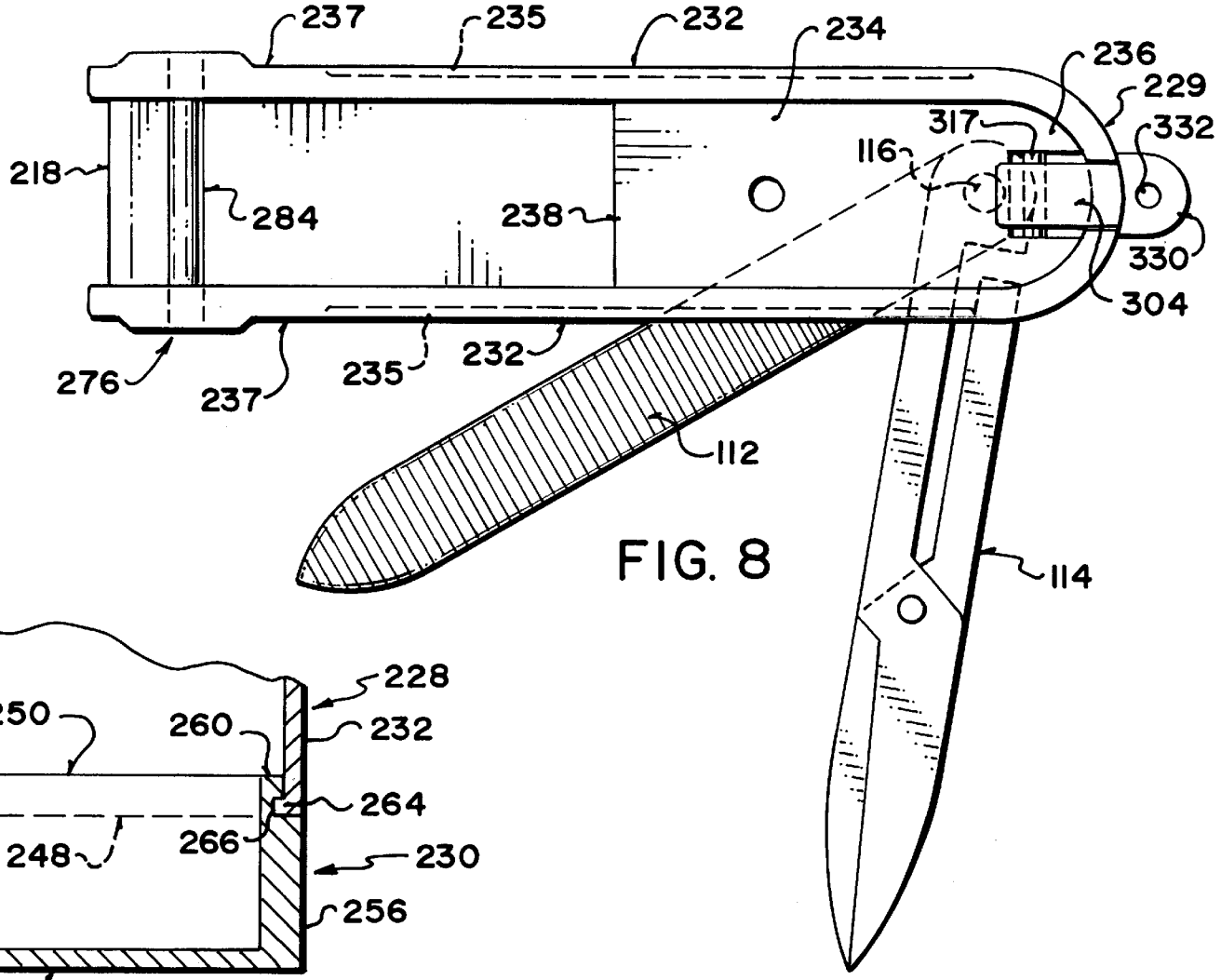
FIG. 8 is a top view of the alternative embodiment of the nail clipper.

Referring to FIGS. 7 and 8 the container 214 includes a first portion 228 and a removable and reengageable second portion 230.

The first portion 228 has a front wall 218, a rear wall 229 opposite the front wall 218, spaced apart side walls 232 extending between the front and rear walls 218 and 229, and a closed top 233. A support flange 234 for supporting a two part clipper 221 is fixed to the rear wall 229 at a rear end 236 and extends forwards of the rear wall 229 to a front end 238. The support flange 234 extends laterally to the side walls 232 of the container 214 and is fixed to the side walls 232 thereby enclosing a first portion of the top of the container 214.

A recessed portion 235 is arranged in each of the side walls 232 in an exterior surface 237 of the side walls 232. The recessed portion 235 is sized and arranged to receive a label, decal, or plate having a name, advertising, or other message, or image on it. The recessed portion 235 allows for the nail clippers 210 to be customized to suit an individual's purposes.

The front wall 218 of the container 214 extends laterally between and substantially perpendicular to the side walls 232 and upwards to a position even with the flange 234 providing an opening 219 above the front wall 218.

The two part clipper 221 includes an upper cutting member 217 and a lower cutting member 216 is fixed to the front end 238 of the flange 234 and extends forwards to the opening 219 above the front wall 218.

The lower cutting member 216 has an elongate portion 223 extending from the flange 234, to a position resting on top of the front wall 218 and an upturned lower cutting edge 225 projecting through the opening 219 in the front wall 218. The lower cutting member 216 is held in place vertically against a downwards force by the front wall 218 and does not move relative to the container 214 when cutting.

The upper cutting member 217 is likewise fixed to the flange 234 of the support member 234, in a cantilever, and has an elongate resilient member 220 extending from the flange 234 to a position above the lower cutting edge 225 and a downturned upper cutting edge 224 projecting through the opening 219 in the front wall 218. The elongate resilient member 220 lies between the side walls 32 of the container 14 enclosing a second portion 44 of the top 33 of the container 14. The downturned upper cutting edge 224 of the elongate resilient member 220 is positioned above the lower cutting edge 225 and is spaced upwards therefrom. The elongate resilient member 220 is free to move between and parallel to the side walls 232.

The upper cutting edge 224 is arranged along the front end of the elongate resilient member 220 and is arranged for co-operation with the lower cutting edge 225 below. The upper cutting edge 224, like the lower cutting edge 225, extends laterally between the side walls 232 in a U-shaped curve.

Figure 11:
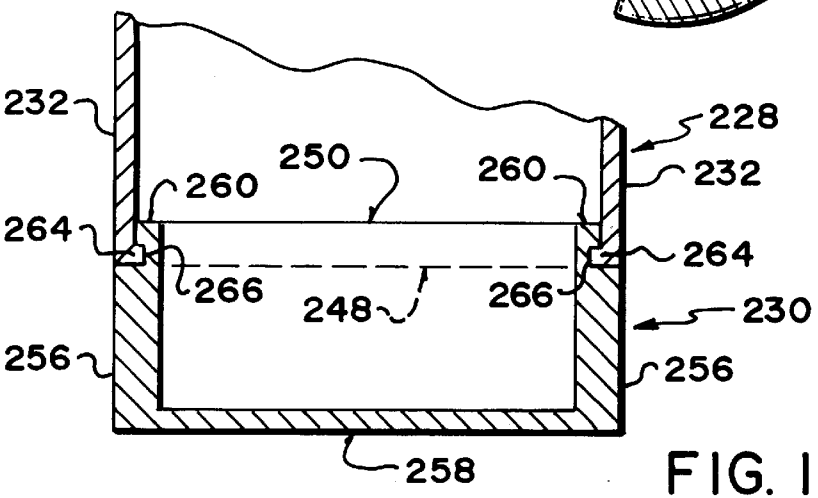
FIG. 11 is a cross sectional view of the first and second portion of the nail clipper through B—B of FIG. 7 showing the alternative attachment means.

Referring to FIGS. 7, 8 and 11 the second portion 230 of the container 214 is attached to a bottom 248 of the first portion 228 and is removable and reengageable therefrom. The second portion 230 like that described above includes an open top wall 250, a front wall 252, a rear wall 254, side walls 256, a closed bottom wall 258, and removable and reengageable attachment means for attaching the open top 250 of the second portion 230 to the open bottom 248 of the first portion 228.

The second portion 230 is arranged to engage within the open bottom of the first portion 228. To achieve this a top portion 260 of the front, rear, and side walls 252, 254, and 256 of the second portion 230 is spaced inwards from respective outer surfaces thereof such that the top portion 260 can slide within the open bottom 248 of the first portion 228.

The attachment means are arranged around the open top portion 260 of the second portion 230 and around the open bottom 248 along an interior of the walls 232 and 229 of the first portion 228 of the container 214. The attachment means in this embodiment comprises a tongue and groove connection comprising a flange member 264, providing the tongue, arranged around the interior of the side and rear walls 232 and 229 of the first portion 228 and a corresponding groove 266 for receiving the flange member 264 arranged in the top portion 260 of the side and rear walls 256 and 254 of the second portion 230. The flange member 264 and top portion 260 both taper inwards slightly along the length of the container 14 in a rearwards direction such that the rear of the top portion 260 can be placed between the slightly wider front ends of flange member 264. This enables the second portion 230 to be slidably placed within the first portion 228.

To secure the second portion 230 of the container 14 to the first portion 228 of the container 14 the top portion 260 of the rear wall 254 of the second portion 230 is placed between the slightly wider front portion of the flange member 264 adjacent the front wall 218 of the first portion 228 and is moved rearwards until the grooves 266 in the second portion 230 engage over the flange member 264 and the rear wall 254 of the second portion 230 contacts the rear wall 229 of the first portion 228 thereby holding the second portion 230 in place within the first portion 228. Sliding the second portion 230 forwards disengages the flange member 264 from the groove 266 allows the second portion 230 to be removed from the first portion 228.

Referring to FIG. 8 the side walls 232 of the first and second portions 228 and 230 of the container 14 when viewed from above extend rearwards of the front wall 218 parallel to one another to the rear wall 229. The rear wall 229 is curved in a part circle extending between the side walls 232.

Referring to FIGS. 7, 8, 9 and 10 the actuator means 226 is a lever member arranged above and spaced from the elongate resilient member 220 and is connected to the side walls 232 of the container 214 adjacent the front wall 218 thereof. The lever member 226 is connected to the side walls 232 of the container 214 by a pivot connection 276. The pivot connection 276 comprises a front end of each side wall 232 of the container 214 which extends upwards above the elongate resilient member 220 and has a pin member 284 extending between the side walls 232 of the container 214 adjacent the front wall 218. The pin member 284 is engaged within a receptacle 290 extending across the lever member 226 pivotally mounting the lever member 226 on the container 214.

The lever member 226 comprises the elongate member 278 extending rearwards from the pivot connection 276. The elongate member 278 has a bottom surface 292 extending rearwards to a rear end 300 of the elongate member 278. The bottom surface 292 has a first portion 294 extending downwards and forwards from the front end 288 to a contact surface 302. A second portion 296 extends upwards and rearwards from the contact surface 302 to the bottom surface 292 of the elongate member 278. The contact surface 302 extends downwards and rearwards in a steep curve to a rounded corner 303 formed at the junction of the contact surface 302 and the second portions 296 of the elongate member 278. The contact surface 302 is arranged close to the front wall 218 of the container 214 as near to the upper cutting edge 224 as possible and is arranged such that the downward and rearward sloping portion lies in contact with the elongate member 220 of the clippers 221 when the clippers are in an open position.

The actuator means 226 selectively moves the upper cutting edge 224 from the open position to a closed position by moving the front end of the elongate resilient member 220 downwards. When in the open position the upper cutting edge 224 is spaced from the lower cutting edge 225, and when in the closed position the upper cutting edge 224 contacts the lower cutting edge 225 thereby cutting a nail placed between the cutting edges and causing the nail to fall into the container.

Downwards movement of the lever member 226 causes the contact surface 302 to rotate downwards until the corner 303 is in contact with the elongate member 220 adjacent its front end. This causes downwards movement of the upper cutting edge 224 from the open position to the closed position and into contact with the stationary lower cutting edge 225 in a cutting motion. This arrangement increases the lever force applied to the clippers 221 by the lever member 226 and reduces the range of motion of the rear end 300 of the lever member 226.

Referring to FIG. 7 and 8 the nail clipper 210 includes a locking means 304 for selectively locking the lever mechanism 226 in the closed position when not in use. The locking means 304 comprises a clip 306 arranged at the rear of the nail clippers 210 for engaging the rear end 300 of the lever member 226 thereby holding the lever member 226 in the closed position. This fully encloses the container 214 thereby preventing cut nails from exiting the container 214.

The clip 306 includes a pivot connection 308 at a bottom end, lever engaging member 310 the top end, and a stem 312 connecting the pivot connector 300 to the lever engagement member 310. A depression 314 is arranged at the rear end 300 of the lever member 226 on both the top 293 and bottom 292 of the lever member 226 for engagement by the lever engagement member 310. The pivot connection 308 comprises a pin 314 arranged across a slot 316 at a rear end of the flange 234 and a C-shaped snap connector 318 for engaging the pin 314 and allowing rotation about the pin 314. The pivot connection 308 allows the clip 306 to be pivoted between a first position engaging the lever member 226, and a second position disengaged from the lever member 226.

The lever engagement member 310 is a U-shaped member arranged such that the arms 320 of the U extend forward and are arranged to engage the top and bottom faces 293 and 292 of the lever 226 when the lever member 226 is in the closed position. Each arm 320 of the U-shaped member includes a projection 322 extending inwards towards the arm 320 opposite for engaging in the depressions 314 in the lever member 226 securing it between the arms 320.

The nail clipper 210 also includes a flange 330 arranged to extend rearwards from an external surface of the rear wall 229. The flange 330 includes a hole 332 extending through the flange 330 for receiving a key ring, chain or similar retainer. This enables an individual to keep the nail clippers on a key ring where they are handy or tethered on a chain of similar retainer to prevent the nail clippers from becoming lost.

While one embodiment of the present invention has been described in the foregoing, it is to be understood that other embodiments are possible within the scope of the invention. The invention is to be considered limited solely by the scope of the appended claims.

I claim:

1. A nail clipper for cutting finger and toe nails comprising:

a container for collecting and containing cut nails including:

a first portion having a front wall, side walls, a rear wall, and an open bottom wall;

a second portion having a front wall, side walls, a rear wall, an open top wall, and a closed bottom wall, said second portion being arranged to slidably engage within at least a portion of the first portion of the container;

and removable and reengageable attachment means for attaching the open top of the second portion within the open bottom of the first portion;

a lower cutting edge arranged adjacent a top edge of the front wall of the first portion of the container;

an elongate resilient member arranged above the lower cutting edge and extending between the side walls of the first portion for movement therebetween, such that the elongate resilient member encloses a top of the first portion;

an upper cutting edge arranged along a front end of the elongate resilient member for co-operation with the lower cutting edge;

and actuator means for selectively moving the front end of the elongate resilient member downwards such that the upper cutting edge contacts the lower cutting edge;

and wherein the second portion includes at least one receptacle having a utensil arranged therein, said utensil being pivotally connected at one end within the receptacle such that the utensil can be pivoted free of the receptacle for use and such that the utensil can be folded back into the receptacle for storage.

2. A nail clipper in accordance with claim 1 wherein the utensil can be pivoted free of the receptacle for use and can be folded back into the receptacle for storage when the second portion is detached from the first portion.

3. A nail clipper in accordance with claim 1 wherein the container includes two receptacles in the second portion, and wherein the first receptacle has scissors arranged therein, said scissors being pivotally connected at one end within the receptacle such that the scissors can be pivoted free of the receptacle for use and such that the scissors can be folded back into the receptacle for storage, and wherein the second receptacle has a nail file arranged therein, said nail file being pivotally connected at one end within the receptacle such that the nail file can be pivoted free of the receptacle for use and such that the nail file can be folded back into the receptacle for storage.

4. A nail clipper for cutting finger and toe nails comprising:

a container for collecting and containing cut nails including:

a first portion having a front wall, side walls, a rear wall, and an open bottom wall;

a second portion having a front wall, side walls, a rear wall, an open top wall, and a closed bottom wall, said second portion being arranged to slidably engage within at least a portion of the first portion of the container;

and removable and reengageable attachment means for attaching the open top of the second portion within the open bottom of the first portion;

a lower cutting edge arranged adjacent a top edge of the front wall of the first portion of the container;

an elongate resilient member arranged above the lower cutting edge and extending between the side walls of the first portion for movement therebetween, such that the elongate resilient member encloses a top of the first portion;

an upper cutting edge arranged along a front end of the elongate resilient member for co-operation with the lower cutting edge;

and actuator means for selectively moving the front end of the elongate resilient member downwards such that the upper cutting edge contacts the lower cutting edge.

5. A nail clipper in accordance with claim 4 wherein the removable and reengageable attachment means are arranged on an exterior of the second portion of the container adjacent a top thereof and on an interior of the first portion of the container adjacent a bottom thereof.

6. A nail clipper in accordance with claim 4 wherein the removable and reengageable attachment means comprise snap fastener means.

7. A nail clipper in accordance with claim 4 wherein each of the front, rear, and side walls of the first and second portions includes an outer surface; and wherein a top portion of each of the front, rear, and side walls of the second portion is spaced inwards of the respective outer surface thereof such that said top portions fit within the open bottom of the first portion; and wherein the outer surfaces of the front, rear, and side walls of the first portion lie adjacent the outer surfaces of the front, rear, and side walls of the second portion respectively; and wherein the adjacent outer surfaces are substantially coplanar with respect to one another.

8. A nail clipper in accordance with claim 7 wherein the removable and reengageable attachment means comprise a tongue and groove means including:

a flange member arranged around an interior of the side and rear walls of the first portion of the container adjacent the open bottom wall thereof;

a groove arranged around the outer surface of the top portion of the side and rear walls of the second portion of the container for receiving the flange member therein;

and wherein the flange member of the first portion of the container and top portion of the side and rear walls of the second portion of the container taper inwards slightly in a direction longitudinally along the container from a front of the container to a rear of the container such that a rear end of the top portion of the second portion of the container can pass between the front ends of flange member thereby enabling the second portion to be slidably placed within the first portion.

9. A nail clipper in accordance with claim 4 wherein the actuator means move the upper cutting edge between an open position and a closed position such that when in the open position the upper cutting edge is spaced from the lower cutting edge, and such that when in the closed position the upper cutting edge contacts the lower cutting edge thereby cutting a nail arranged therebetween and causing said nail to fall into the container.

10. A nail clipper in accordance with claim 9 wherein the elongate resilient member is fixed at its rear end to a rear wall of the container and extends between the side walls of the container and wherein the front end of the elongate resilient member is free to move between said side walls, and wherein the lever member is arranged above the elongate resilient member and is pivotally connected to the side walls of the container at a front end and includes a contact surface spaced rearwards of the front end arranged to engage a top surface of the elongate resilient member for selectively moving the elongate resilient member upwards and downwards.

11. A nail clipper in accordance with claim 10 wherein the contact surface engages the elongate resilient member adjacent its front end such that downward movement of the lever member causes downward movement of the contact surface and the front end of the elongate resilient member such that the upper cutting edge moves into contact with the stationary lower cutting edge.

12. A nail clipper in accordance with claim 10 wherein lever member comprises:

an elongate member having a front end, a rear end, a top surface and a bottom surface;

a first portion extending downwards and forwards from the front end of the elongate member;

a contact surface extending downwards and rearwards from the first portion in a steep curve to a rounded corner;

a second portion extending upwards and rearwards from the rounded corner of the contact surface to the bottom surface of the elongate member;

and wherein the contact surface is arranged adjacent the upper cutting edge of the elongate member such that when the clippers are in the open position the downward and rearward sloping portion lies in contact with the elongate member.

13. A nail clipper in accordance with claim 12 wherein downwards movement of the lever member causes the contact surface to rotate downwards until the corner is in contact with the elongate member adjacent the front end thereof thereby causing downwards movement of the upper cutting edge from the open position to the closed position bringing the upper cutting edge into contact with the stationary lower cutting edge in a cutting motion.

14. A nail clipper in accordance with claim 13 wherein the lever member is connected to the side walls of the container by a pivot connection comprising:

an upwardly extending portion of the front end of each side wall of the container;

a pin member extending between the upwardly extending portions of the side walls;

and a receptacle extending across the lever member adjacent the front end thereof for receiving the pin therein thereby pivotally mounting the lever member on the container.

15. A nail clipper in accordance with claim 12 including locking means for selectively locking the actuator means in the closed position when not in use, thereby preventing cut nails from exiting the container.

16. A nail clipper in accordance with claim 15 wherein the locking means comprise a clip arranged at a rear of the nail clippers for engaging a rear end of the lever member thereby holding the lever member in the closed position, said clip including a pivot connection at a bottom end thereof, a lever engaging member at a top end thereof for engaging the rear end of the lever member, and a stem connecting the pivot connector to the lever engagement member, said pivot connection allowing the clip to be pivoted between a first position engaging the lever member thereby securing the lever member in the closed position, and a second position disengaged from the lever member.

17. A nail clipper for cutting finger and toe nails comprising:

a container for collecting and containing cut nails having a front wall, side walls, a rear wall, and an open bottom wall;

a lower cutting edge arranged adjacent a top edge of the front wall;

an elongate resilient member arranged above the lower cutting edge and extending between the side walls for movement therebetween, such that the elongate resilient member encloses a top of the container;

an upper cutting edge arranged along a front end of the elongate resilient member for co-operation with the lower cutting edge;

actuator means for selectively moving the front end of the elongate resilient member downwards such that the upper cutting edge contacts the lower cutting edge;

and a recessed portion arranged in at least one of the side walls of the container in an exterior surface thereof, said recessed portion being sized and arranged to receive a label therein.

18. A nail clipper in accordance with claim 17 wherein the container includes:

a first portion having a front wall, side walls, a rear wall, and an open bottom wall;

a second portion having a front wall, side walls, a rear wall, an open top wall, and a closed bottom wall, said second portion being arranged to slidably engage within at least a portion of the first portion of the container;

and removable and reengageable attachment means for attaching the open top of the second portion within the open bottom of the first portion;

and wherein the lower cutting edge is arranged adjacent a top edge of the front wall of the first portion of the container;

and wherein the elongate resilient member is arranged above the lower cutting edge and extends between the side walls of the first portion for movement therebetween, such that the elongate resilient member encloses a top of the first portion.

19. A nail clipper in accordance with claim 18 wherein the recessed portion is arranged in at least one of the side walls of the first portion of the container.

* * * * *